United States Patent [19]

Newman et al.

[11] 4,456,148

[45] Jun. 26, 1984

[54] MOVABLE SELECTION CARRIER

[75] Inventors: Alec T. Newman, Nr. Banbury; David Rhodes, Banbury; Brian A. Edge, Rugby, all of England

[73] Assignee: General Foods Limited, Banbury, England

[21] Appl. No.: 343,685

[22] Filed: Jan. 28, 1982

[51] Int. Cl.[3] ..... B65H 3/24

[52] U.S. Cl. ..... 221/132; 221/265

[58] Field of Search ..... 221/132, 103, 105, 133, 221/123, 113, 11, 256, 257, 265, 5, 126, 6, 94, 18, 95, 96, 150 A; 198/366, 369; 53/212, 253; 186/55, 56

[56] References Cited

U.S. PATENT DOCUMENTS

| | | | |
|---|---|---|---|
| 3,247,940 | 4/1966 | Christine et al. | 221/96 X |
| 3,554,404 | 1/1971 | Schmid | 221/95 |
| 3,893,589 | 7/1975 | Mandell | 221/123 |

FOREIGN PATENT DOCUMENTS

| | | |
|---|---|---|
| 38433 | 3/1981 | Fed. Rep. of Germany . |
| 899068 | 6/1962 | United Kingdom . |
| 1082150 | 9/1967 | United Kingdom . |
| 1482031 | 8/1977 | United Kingdom . |
| 1546312 | 5/1979 | United Kingdom . |

*Primary Examiner*—Stanley H. Tollberg

*Attorney, Agent, or Firm*—Walter Scott; Joyce P. Hill; Thomas R. Savoie

[57] ABSTRACT

Vending apparatus for dispensing discrete articles stacked one above the other such as a stack of pre-filled cups with dry ingredients for mixing with water to make a beverage. The apparatus includes stationary support rings for supporting a plurality of stacks of articles arranged about a vertical axis. An actuating device is adapted to select an article from a particular stack, and for releasing the lowermost article of the selected stack into a carrier. An indexing drive moves the carrier, if necessary, between a discharge station and a position beneath each stack and then returns the carrier to the discharge station, with the selected article being held in the carrier at least until the carrier reaches the discharge station.

14 Claims, 12 Drawing Figures

4

5

1

3

2

6

MOVABLE SELECTION CARRIER

DESCRIPTION

1. Technical Field

This invention relates to vending apparatus.

2. Background Art

It is known to provide vending apparatus for dispensing cups pre-filled with dry ingredients for mixing with water to make a beverage. The cups are stored in a stack, and on operation of the apparatus the lowermost cup of the stack is released and delivered to a discharge point accessible to the customer. If desired a choice of with or without sugar may be provided by dispensing sugar, if selected, into the cup after it has been released from the stack.

It is also known to provide a vending apparatus which offers a range of beverages. At least one stack of cups of each beverage is stored within the apparatus from which the desired beverage may be chosen, the selected cup being delivered to the discharge point.

DISCLOSURE OF INVENTION

According to the invention there is provided vending apparatus for dispensing discrete articles stacked one above another, the apparatus comprising stationary means for supporting a plurality of stacks of articles, means for actuating the apparatus to select an article from a particular stack, means for releasing the lowermost article of the selected stack into a carrier, indexing drive means for moving the carrier, if necessary, between a discharge station and a position beneath each stack and then returning the carrier to the discharge station, and means for holding the selected article in the carrier at least until the carrier reaches the discharge station.

In one embodiment of the invention the stacks of articles are arranged about a vertical axis, and the carrier is mounted for rotation about the axis. Alternatively, the stacks may be arranged along a straight or arcuate path along which the carrier is constrained to move. In each case the discharge station of the carrier may be coincident with its position beneath one of the stacks.

The means for holding the selected article in the carrier may comprise an arm movable between an operative position beneath the carrier and an inoperative position to allow the article to drop from the carrier. The arm may be withdrawn radially into its inoperative position, for example, by a solenoid. Alternatively, the article may be arranged to be lifted manually or pneumatically from the carrier, in which case the arm need not be releasable.

Preferably gate means are provided at the lower end of each stack of articles, which gate means support the respective stack and are movable longitudinally of the stack to release the lowermost article therefrom when the carrier is located beneath the stack. The gate means for each stack may be movable by the carrier or means attached thereto.

In a preferred embodiment of the invention each stacked article is a cup pre-filled with dry ingredients for mixing with water to make a beverage. In this case the apparatus may also have a sugar and/or water station, together with a source of hot and/or cold water as described, which station or stations may be coincident with the discharge station. The carrier may also be arranged to enable a cup therein to tilt relative to the vertical. Such movement is advantageous if it is required to dispense a further dry ingredient, e.g., sugar, into the cup or to fill the cup with water. The carrier may be a cylindrical holder. Alternatively, each cup may have a rim and the carrier may comprise a form of calliper for holding the cup beneath the rim.

Sensing means may be provided for determining when each stack is reduced to a predetermined level, the sensing means for each stack then indicating, for example in a manner which is visible to the customer, that the respective stack is "sold out," and acting to inhibit the carrier from moving to that stack. The sensing means may be a microswitch or photo-electric cell but is preferably an infra-red cell.

The vending apparatus may be actuated by a coin-feed mechanism.

BRIEF DESCRIPTION OF DRAWING

By way of example, a specific embodiment in accordance with the invention will be describe with reference to the accompanying diagrammatic drawings in which.

BEST MODE OF CARRYING OUT THE INVENTION

This example relates to a vending apparatus of the type which is capable of dispensing a range of beverages in cups. Each beverage of the range is supplied from a respective stack of cups pre-filled with the dry ingredients of the particular beverage. To reduce the number of stacks required for any particular range of beverages, sugar, if selected, may be dispensed into the cup as a separate operating step between releasing the cup from its stack and its arrival at the discharge point where the cup is accessible to the customer. Hot water may also be dispensed into the cup from a source provided either automatically or by the customer after the selected cup has been discharged. If desired two or more of the stacks may comprise cups pre-filled with the dry ingredients of the same beverage.

In this particular embodiment, the vending apparatus is designed to store four stacks of cups. Two of the stacks of cups are pre-filled with coffee and dried milk, one stack of cups is pre-filled with coffee only, and the fourth stack of cups is pre-filled with chocolate powder. Sugar is dispensed separately in a similar manner to that described in British Patent Specification No. 1,559,305, and the customer fills the selected cup with hot water after it has been discharged.

Figure 1:
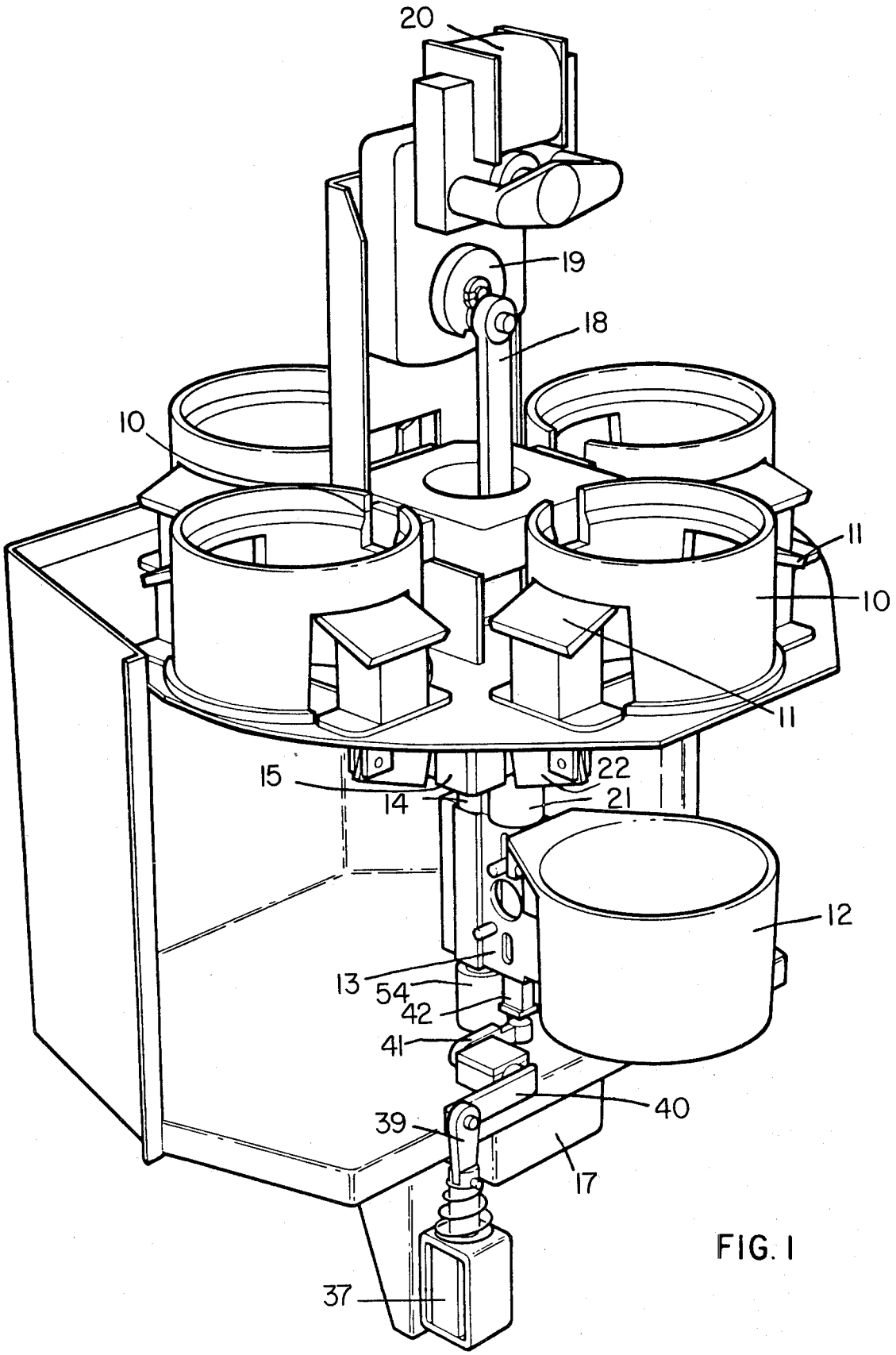
FIG. 1 is a perspective view of a vending apparatus for dispensing a range of beverages.

Referring to the drawings, the four stacks of cups pre-filled with their dry ingredients extend upwardly from respective stationary support rings 10, the lowermost cup of each stack being disposed within the respective ring and supported by diametrically opposed gate means 11 shown only diagrammatically in FIG. 1. Operation of the gate means of any one of the stacks causes the lowermost cup in the stack to be released downwardly therefrom.

Figure 5:
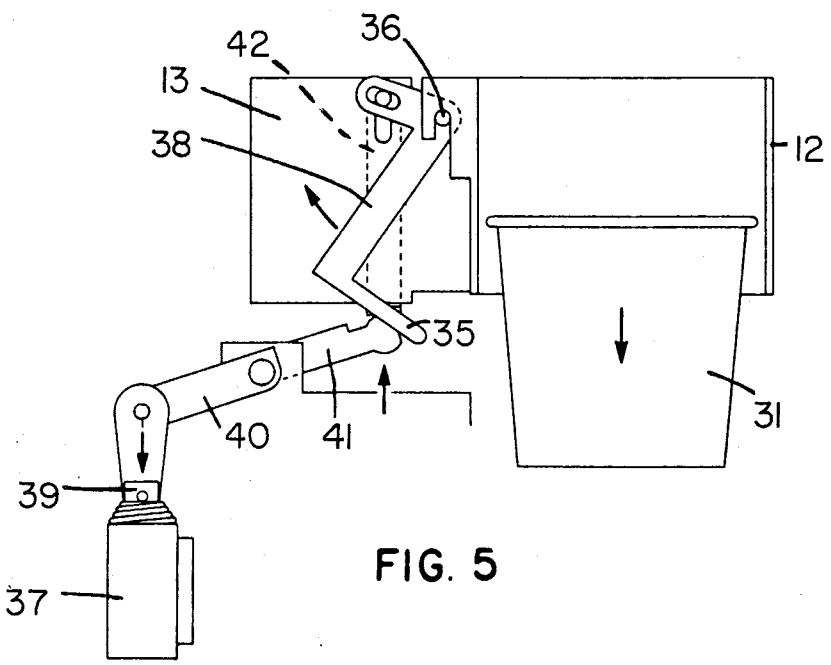
FIGS. 4 and 5 illustrate the operation of the releasable means for holding a cup in the carrier in a tilted position.

In this embodiment the stack support rings 10 are arranged in a square and to catch the released cup there is provided a cylindrical carrier 12 mounted for rotary movement, if necessary, about a vertical axis from a discharge station in which the carrier is shown in FIG. 1 to a position beneath each stack and then back to the discharge station. Attached to the carrier 12 is an arm 35 (FIGS. 4 and 5) which projects part way beneath the carrier in a radial direction to hold the caught cup until the carrier has returned with the cup to the discharge station. Radial withdrawal of the arm then allows the cup to drop from the carrier through a conventional chute (not shown) to a discharge point in which it is readily accessible to the customer. Alternatively, the apparatus could be arranged so that the customer lifts the cup out of the carrier, in which case the carrier may have fixed holding means, e.g., a solid base.

In another embodiment the apparatus is provided with pneumatically operated means to raise the cup from the carrier, e.g., through a guide tube, to a level which is more readily accessible to the customer.

Figure 3:
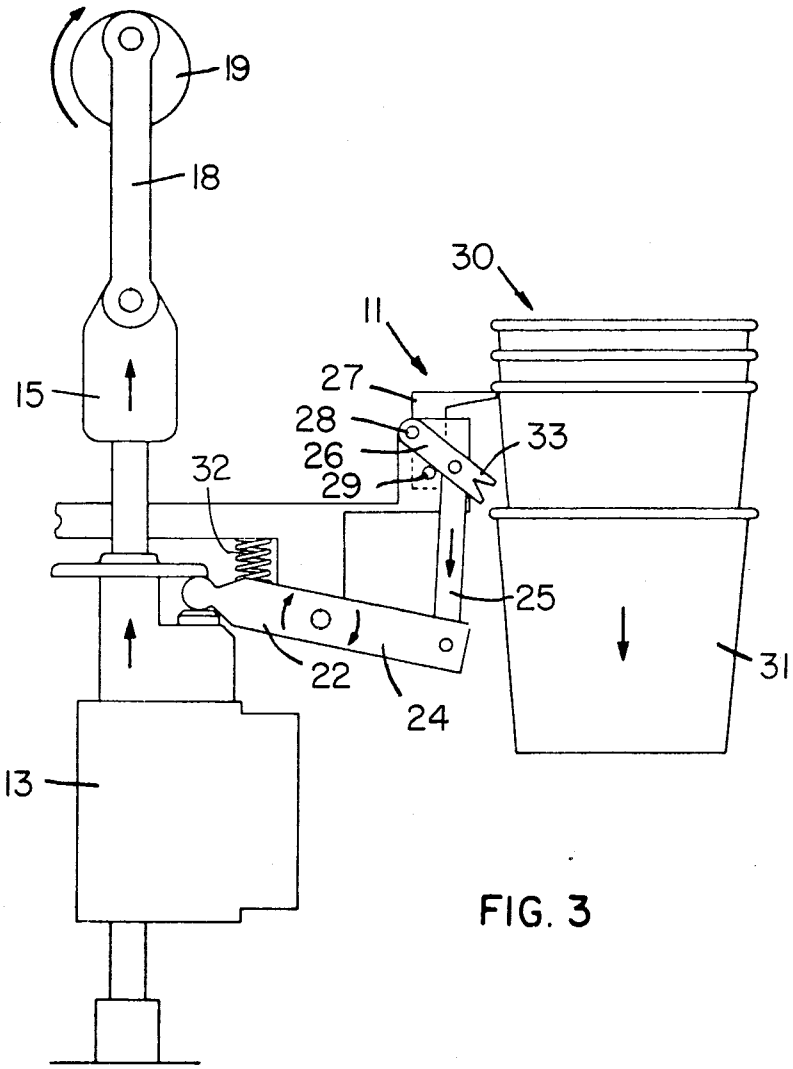
FIGS. 2 and 3 illustrate the operation of one of the gate means for supporting each stack of cups and releasing the lowermost cup.

The carrier 12 is mounted on an arm 13 attached to a shaft 14 (FIGS. 2 and 3) which is mounted in bearings 15, 16 and driven by indexing drive means 17. The shaft 14, and thereby the arm 13 and carrier 12, is also movable vertically by a link 18 pivotally attached at one end to the upper bearing 15 for the shaft 14 and its other end to a cam 19 driven through a linkage by an electric motor 20. The mounting of the shaft 14 in the upper bearing 15 is such that the shaft may rotate within the upper bearing but not move longitudinally relative thereto. The link 18 is thus not affected by rotation of the shaft.

When the carrier 12 is lifted by the upward movement of the link 18 effected by rotation of the cam 19 through the first half of one revolution, a spring-loaded button 21 lifts the stem of a Y-shaped frame 22 which controls the two gate means 11 of the respective stack 30. The frame 22 is pivotally mounted on a spindle 23 and has its arms 24 attached by a pair of links 25 (only one of which is shown) to the respective gate means 11.

Each gate means 11 comprises two flaps 26, 27 both of which are pivotally movable about respective horizontal spindles 28, 29. The lower flap 26 is also pivotally connected to the links 25, and serves both to support the associated stack of cups until that stack is selected by the customer and then to assist the release of the lowermost cup from the stack. The upper flap 27 serves to temporarily support the remainder of the stack whilst the lowermost cup is being released.

Figure 2:
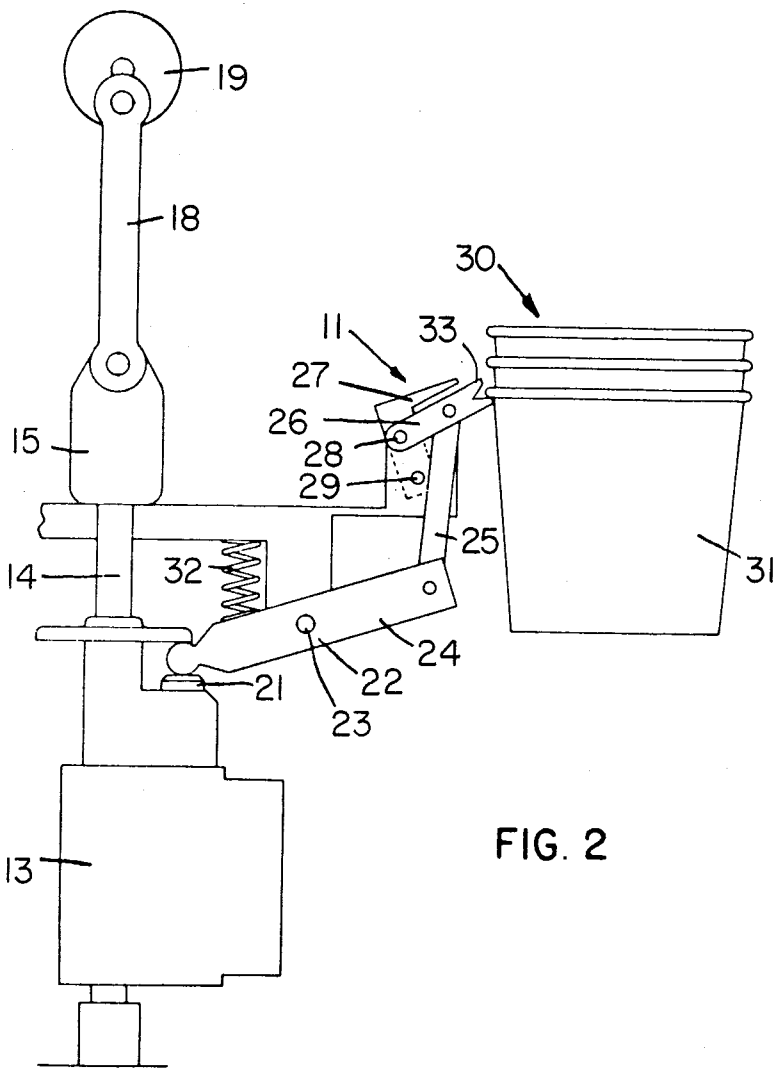

FIG. 2 illustrates the normal rest position of one of the two gate means 11 for each stack 30, the flaps 26, 27 and the stack being turned through 90° for the purpose of clarity to show their operation. In this position the forked end of the lower flap 26 of each gate means engages beneath the rim of the lowermost cup 31 and thereby the two lower flaps support the stack. Pivotal movement of the frame 22 against a spring 32, caused by lifting the carrier 12, draws both lower flaps 26 downwardly which allows a spring (not shown) to pivot the associated upper flap 27 inwardly towards the stack. The upper flaps 27 thereby engage beneath the rim of the next lowest cup. Simultaneously the forked end of each of the lower flaps 26 engages the upper surface of the rim of the lowermost cup to assist its release. The flaps 26, 27 of each gate means are then in their positions shown in FIG. 3, and the lowermost cup drops into the carrier 12 which is disposed beneath the stack.

Rotation of the cam 19 through the second half of one revolution causes the link 18 to move downwardly and hence lowers the carrier 12 with the released cup 31 therein. Such downward movement of the carrier allows the spring 32 to cause the frame 22 to raise the lower flaps 26 into engagement with the underside of the rim of the cup which is then the lowermost cup of the stack and appropriate stops (not shown) on the lower flaps simultaneously pivot the respective upper flaps outwardly with respect to the stack returning them to their rest position.

Figure 4:
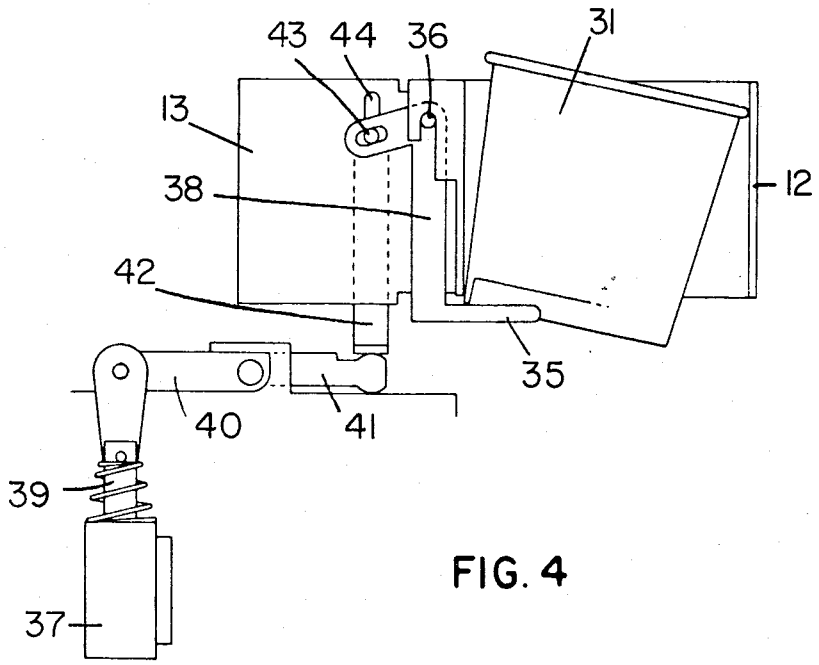
Figure 6:
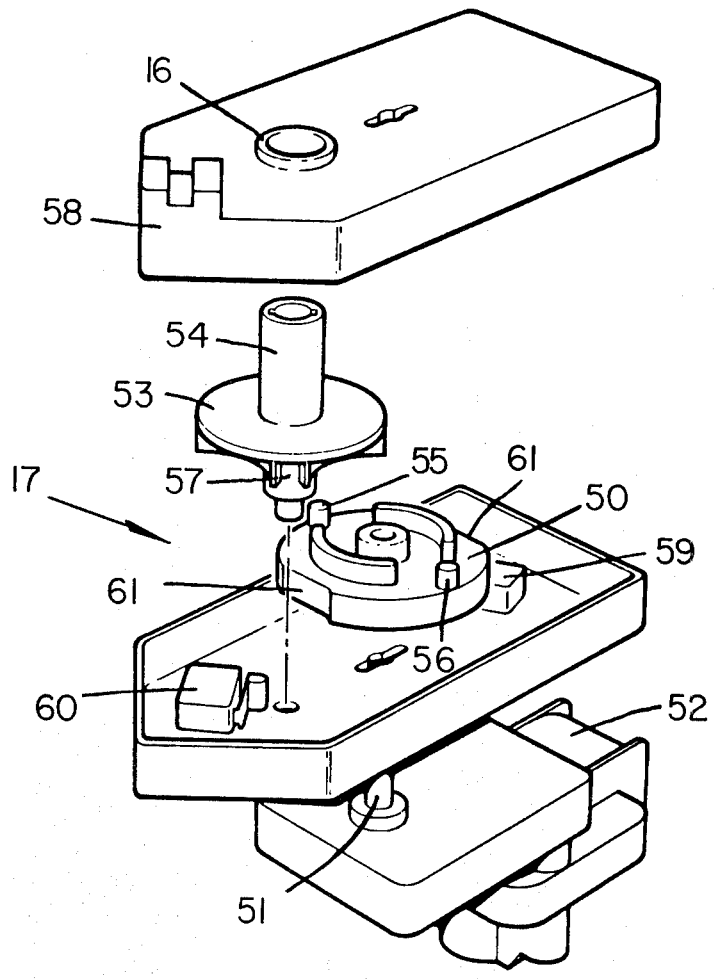
FIG. 6 is a perspective, exploded view of the indexing drive means for the carrier.
Figure 10:
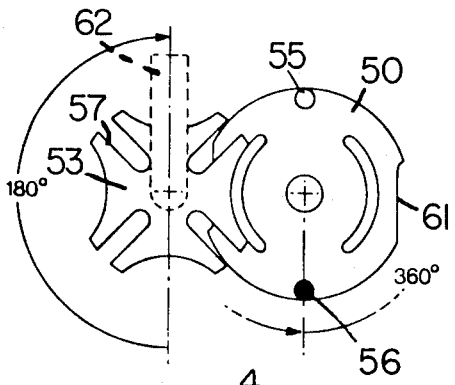
FIGS. 7 to 12 illustrate the operation of the drive means of FIG. 6.
Figure 11:
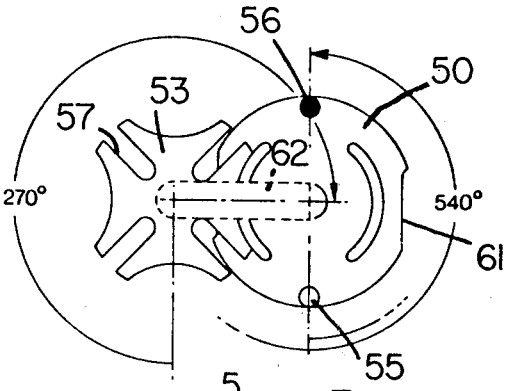

As shown in FIG. 4, the radial arm 35 beneath the carrier 12 holds the cup 31 in the carrier, but in association with the oversize internal diameter of the carrier allows the cup to tilt to a position inclined to the vertical. This inclined position of the cup 31 assists the introduction of sugar into the cup when the carrier has been returned to the discharge station, if sugar has been selected.

The radial arm 35 forms one part of a generally L-shaped member 38 which is pivotally mounted on a spindle 36 which also serves, in this embodiment, to mount the carrier 12 on the arm 13. Pivotal movement of the L-shaped member to withdraw the arm 35 radially from beneath the carrier 12 (FIG. 5) is effected by a solenoid 37 having a plunger 39, to which the L-shaped member 38 is connected by a linkage comprising a horizontal lever 40 pivotally connected to the plunger, an intermediate level 41 and a link 42 connected to the L-shaped member by a pin 43 which is guided for vertical movement in a slot 44. The cup 31 then drops from the carrier into the above-mentioned chute which delivers the cup to the discharge point at which the cup is accessible to a customer. The discharge point is conveniently an opening in the casing of the vending apparatus which is normally closed by a manually movable access flap.

Figure 7:
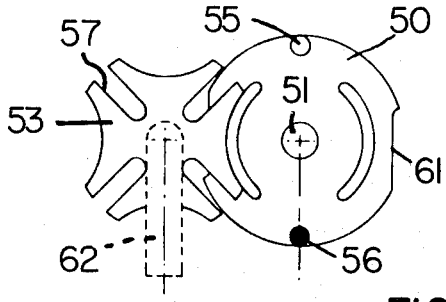
Figure 9:
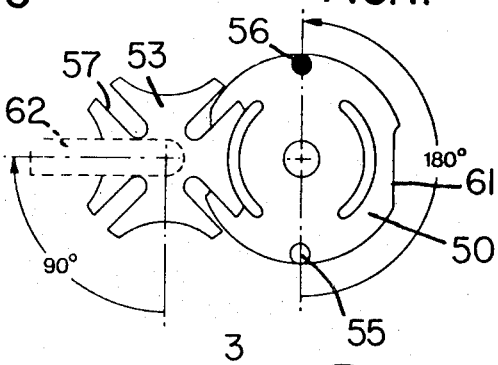
Figure 8:
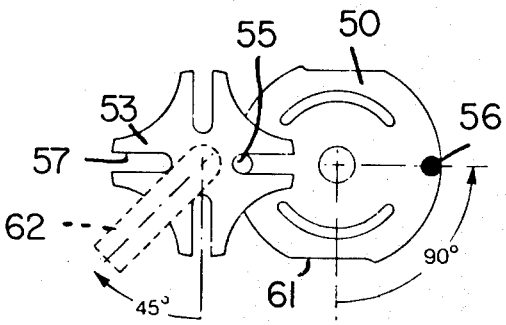
Figure 12:
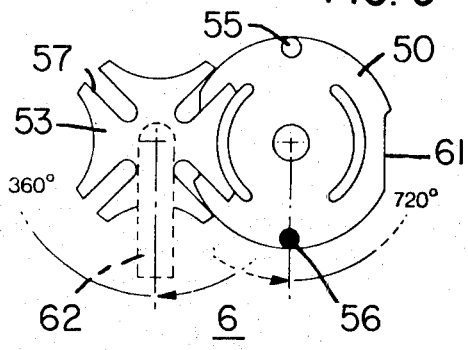

The indexing drive means 17 for the carrier 12 will now be described. The drive means basically comprises an input wheel 50 mounted on a shaft 51 driven by an electric motor 52, and an output wheel 53 having an upwardly extending hub 54 which is locked against relative rotation to the above-mentioned shaft 14 on which the carrier 12 is mounted. The input wheel has two upstanding, diametrically opposed pins 55, 56 capable of engaging alternately in one of four circumferentially equally-spaced radial slots 57 in the underside of the output wheel 53. Each slot 57 is open at its outer end for reception of one of the pins 55, 56 therein whereby the two wheels 50, 53 are in intermittent driving connection. This means that rotation of the input wheel 50 through 90° will rotate the output wheel in the opposite direction through 45° (see FIGS. 7 and 8). Similarly, FIGS. 9 to 12 show the relative portions of the two wheels 50, 53 after rotation of the input wheel through 180°, 360°, 540° and 720° which correspond to the portions required to index the output wheel 53 and hence the carrier 12 from the discharge station beneath one of the stacks shown in FIG. 1 to portions beneath the other three stacks in turn and back to the discharge station. The input and output wheels 50, 53 are housed in a two part casing of which the upper part 58 is fitted with the lower bearing 16 for the shaft 14 through which the hub 54 of the output wheel 53 projects. The height of the hub 54 is also sufficient to allow the shaft 14 to be lifted by the link 18 without disconnection of the drive thereto.

Two microswitches 59, 60 are provided in the casing for the input and output wheels 50, 53 to control the operation of the motor 52. The microswitch 59 is actuated by one of two diametrically opposed, peripheral detents 61 on the input wheel to indicate that each indexing step has been achieved, and the microswitch 60 is operable by a member 62 (shown in dash lines in FIGS. 7 to 12) projecting radially outwardly from the output wheel 53 to switch off the motor 52 when the carrier 12 is at the discharge station.

Sensing means (not shown), for example a microswitch, photo-electric cell or preferably an infrared cell, is associated with a visible indicator for each stack 30 to indicate that the particular stack has reached a predetermined level and is thus "sold out". and to inhibit the carrier from being indexed by the drive means 17 to that stack. The sensing means view the respective stack 30 through the notch 70 (FIG. 1) in the support ring 10 of the stack.

Operation of the vending apparatus is initiated by feeding the necessary coin or coins into a conventional coin-feed mechanism provided. The desired beverage and whether sugar is required is then selected. Thereafter the motor 52 will index the carrier 12, if necessary, from the discharge station to a position beneath the appropriate stack 30. The motor 20 will reciprocate the link 18 to cause the lowermost cup 31 of the stack 30 to drop into the carrier, the cup tilting into a position inclined to the vertical. The motor 52 will then again be operated, if necessary, to return the carrier to the discharge station. Sugar, if it has been selected, will be dispensed into the cup in the carrier. The solenoid 37 will then be operated to release the cup from the carrier into the chute for delivering the cup to the discharge point at which the cup is accessible to the customer. The customer will then finally fill the cup with hot water to complete the process.

The invention is not restricted to the specific details of the embodiment described above. For example, the indexing drive means may be adapted to index the carrier 12 to more than four positions, either because there are more than four stacks of cups or because the discharge station or a separate sugar and/or hot water dispensing station is not directly beneath one of the stacks. The motor 52 may also be a reversible motor whereby the carrier may be moved to the selected stack or back to the discharge station in either direction as may be desired.

Instead of the carrier 12 being cylindrical, it may comprise a form of calliper capable of gripping the released cup beneath the rim. Such a calliper may be inclined to the horizontal to provide the feature of tilting the cup to assist dispensing sugar and/or hot water therein.

If desired the vending apparatus may be arranged to be operated without a coin-fed mechanism.

Furthermore, means for holding the cup having the selected beverage in the carrier need not be mounted on the carrier. Instead the holding means may comprise stationary holding means which are continuous around the central axis whereby the cup is lifted from the carrier at the discharge station, or similar stationary holding means which are discontinuous at the discharge station whereby the cup drops automatically from the carrier after it has been indexed, if necessary, back to the discharge station.

Similarly the gate means for each stack may comprise a conventional cam arrangement instead of the upper and lower flaps described.

Still further, the carrier need not move in a rotary path. Alternatively, the carrier may be moved, e.g., reciprocated, along a straight or other desired path beneath the plurality of stacks of cups pre-filled with the range of beverages available for selection.

The specific range of beverages which may be selected from the vending apparatus may be altered as desired. For example, one or more of the available beverages may require cold water instead of hot water, in which case a suitable cold water source would be provided in addition to the supply of hot water.

The vending apparatus may also be adapted to dispense other discrete articles stacked one above another, e.g., empty cups, containers pre-packed with food items or empty containers, or packets of cigarettes.

We claim:

1. A vending apparatus for dispensing discrete articles stacked one above another, the apparatus comprising stationary means for supporting a plurality of stacks of articles, said stacks of articles being arranged about a vertical axis; means for actuating the apparatus to select an article from a particular stack; a carrier for receiving an article, said carrier being mounted for rotation about said vertical axis; means for releasing the lowermost articles of the selected stack into said carrier, indexing drive means for moving the carrier between a discharge station and a position beneath each stack and then returning the carrier to the discharge station; and means for holding the selected article in the carrier at least until the carrier reaches the discharge station, wherein the means for holding the selected article in the carrier is an arm movable between an operative position beneath the carrier and an inoperative position to allow the article to drop from the carrier.

2. A vending apparatus for dispensing discrete articles stacked one above another, the apparatus comprising stationary means for supporting a plurality of stacks of articles, said stacks of articles being arranged about a vertical axis; means for actuating the apparatus to select an article from a particular stack; a carrier for receiving an articles, said carrier being mounted for rotation about said vertical axis; means for releasing the lowermost articles of the selected stack into said carrier, indexing drive means for moving the carrier between a discharge station and a position beneath each stack and then returning the carrier to the discharge station; and means for holding the selected articles in the carrier at least until the carrier reaches the discharge station which further comprises a gate means at the lower end of each stack of articles, said gate means supporting the respective stack and being movable longitudinally of the stack to release the lowermost article therefrom when the carrier is located beneath the stack.

3. Vending apparatus as claimed in claim 2, the gate means for each stack being movable by the carrier.

4. Vending apparatus as claimed in claim 3, said gate means being movable by means attached to said carrier.

5. Vending apparatus as claimed in claim 1 or 2, wherein each stacked article is a cup pre-filled with dry ingredients for mixing with water to make a beverage.

6. Vending apparatus as claimed in claim 5, including a station for adding sugar to a released cup.

7. Vending apparatus as claimed in claim 5, including a station for adding water to a released cup.

8. Vending apparatus as claimed in claim 6, wherein said sugar-adding station is coincident with the discharge station.

9. Vending apparatus as claimed in claim 7, wherein said water-adding station is coincident with the discharge station.

10. Vending apparatus as claimed in claim 5, wherein said carrier includes means for tilting a cup relative to the vertical axis.

11. Vending apparatus as claimed in claim 2, wherein said carrier is a cylindrical holder.

12. Vending apparatus as claimed in claim 5, wherein each cup has a rim and the carrier has a calliper form for holding the cup beneath the rim.

13. Vending apparatus as claimed in claim 1 or 2, including sensing means for determining when each stack is reduced to a predetermined level, the sensing means for each stack then indicating that the respective stack is "sold out," and acting to inhibit the carrier from moving to that stack.

14. Vending apparatus as claimed in claim 1 or 2, wherein the apparatus is actuated by a coin-fed mechanism.

* * * * *